United States Patent [19]

Lodovico et al.

[11] Patent Number: 4,923,126

[45] Date of Patent: May 8, 1990

[54] MACHINE FOR CUTTING DISPOSABLE CONTAINERS

[75] Inventors: Frank J. Lodovico, Delmont; John W. Wagner, New Alexandria, both of Pa.

[73] Assignee: John W. Wagner, New Alexandria, Pa.

[21] Appl. No.: 207,147

[22] Filed: Jun. 15, 1988

[51] Int. Cl.[5] ..... B02C 19/14

[52] U.S. Cl. ..... 241/30; 241/99; 241/100; 241/222; 241/166; 241/236

[58] Field of Search ..... 241/99, 236, 166, 167, 241/295, 56, 100, 30, 222

[56] References Cited

U.S. PATENT DOCUMENTS

| | | | |
|---|---|---|---|
| 3,986,676 | 10/1976 | Husmann | 241/56 X |
| 4,625,925 | 12/1986 | Goldhammer | 241/236 |
| 4,669,673 | 6/1987 | Lodovico et al. | 241/99 |
| 4,717,085 | 1/1988 | Crane | 241/236 |

FOREIGN PATENT DOCUMENTS

| | | | |
|---|---|---|---|
| 2723281 | 12/1978 | Fed. Rep. of Germany | 241/236 |

*Primary Examiner*—Mark Rosenbaum
*Attorney, Agent, or Firm*—James L. Sherman

[57] ABSTRACT

A machine is capable of cutting into small pieces the thin wall material of a plurality of disposable containers such as plastic bottles or metal cans fed in a first direction one at a time to a cutting section. The cutting section includes a pair of parallel shafts mounted for rotation in opposite directions about the center axes thereof. Each of the shafts rigidly supports a plurality of overlapping cutting wheels for rotation therewith. Each cutting wheel has a plurality of identical cutting teeth thereon having an apex at the maximum diameter and a root at a root diameter of the cutting wheel. Each cutting tooth has a leading surface and a trailing surface which meet at the apex to form a straight edge at the maximum diameter which is parallel with the center axis of the shaft. The leading surface and the trailing surface respectively lie in planes which are parallel with the center axis of the shaft and extend toward the same side thereof to cause the straight edge of the apex to circumferentially lead a remainder of the leading surface during rotation of the cutting wheel.

17 Claims, 4 Drawing Sheets

MACHINE FOR CUTTING DISPOSABLE CONTAINERS

BACKGROUND OF THE INVENTION

1. Field of the Invention.

This invention relates to a machine capable of cutting any one of numerous sizes of disposable containers such as plastic bottles and/or metal cans into small pieces.

2. Description of the Prior Art.

Recent legislation regulating the collection and disposition of disposable containers such as plastic bottles and metal cans in the soft drink industry has resulted in increased interest in machines that can be employed to reduce the size of the used containers to simplify handling and storage. Two recently devised machines have been primarily successful in satisfying these objectives.

The first of these machines is of a type which is intended to cut a large number of containers simultaneously and is disclosed in U.S. Pat. No. 4,729,515 entitled "Machine For Cutting Disposable Containers", issued on Mar. 5, 1988 to John W. Wagner and incorporated by reference herein. This machine is intended to be operated by operating personnel at a container collecting facility such as a grocery store or the like. For example, depending on the sizes of the plastic bottles, twenty to forty plastic bottles can be initially loaded in the upper loading section of the machine. When the top of the loading section is closed, the machine can be turned on to cause the bottles to be cut in a centrally located cutting section. The cutting section includes a pair of parallel shafts mounted for rotation in opposite directions with each shaft having a plurality of cutting wheels mounted for rotation thereon. The cutting section cuts the containers into plastic strips or pieces which are then collected at a collecting section therebelow.

The second of these machines is employed to separately cut individual bottles as they are separately fed to a "reverse vending machine". A reverse vending machine is a machine which is installed in grocery stores or the like for customers to directly deposit plastic bottles or metal cans therein. At the same time the machine cuts the container into small pieces to decrease the overall volume of plastic or metal collected therein, the customer receives a token or other redemption of a deposit paid when the soft drink or other beverage was initially purchased. Such a machine is disclosed in U.S. Pat. No. 4,669,673 entitled "Apparatus For Cutting Disposable Containers", issued on Jun. 2, 1987 to Frank J. Lodovico and John W. Wagner and incorporated by reference herein. This machine utilizes a first cutting section similar to that disclosed in U.S. Pat. No. 4,729,515 but also includes a second cutting section to transversely cut the elongated strips as they are being discharged from the first cutting section in order to produce smaller pieces. The production of smaller pieces means that a greater number of plastic bottles can be cut for the same volume of the collecting section. In other words, cutting into the smaller pieces reduces the overall volume of material requiring less frequent attention by the store personnel and greater savings in space for future transportation.

Clearly, with such a machine it is essential for the containers to be continuously fed for cutting without any jamming or failure. In fact, to insure that a customer will not deposit a container in the machine prior to proper cutting of the immediately preceding container, the machine includes sensing devices to determine that each container passes by the entrance for proper cutting in the cutting section. As a result, any failure or delay in cutting could cause complete loss of the machine to subsequent customers wishing to redeem containers until the machine is cleared by store personnel. To insure proper feeding, an improved, reliable feeding system is taught in U.S. Pat. No. 4,703,899 entitled "Feeding Device For A Container Cutting Machine" issued on Nov. 3, 1987 to Frank J. Lodovico and incorporated by reference herein.

Because of the reduction of volume created by the smaller pieces, it is clear that there remains a need for any machine which can effectively cut disposable containers into small pieces. While the machine of U.S. Pat. No. 4,669,673 is extremely reliable and effective, the machine does require a second cutting section including additional cutting elements and an additional drive system. Any means which could be employed to eliminate these elements while still producing the more desired smaller pieces of the disposable container would clearly be attractive. With the overall reliability and satisfaction of the basic container cutting machine, it would seem desirable to find some means for adding additional cutting capabilities within the basic machine so that the second cutting section of the machine taught in U.S. Pat. No. 4,669,673 might be unnecessary.

If fact, that are a number of machines utilized in the paper, cardboard, or sheet material cutting art which produce a basic cutting at the edges of cutting discs or wheels and employ other means for producing a transverse cut of the material therein to produce smaller pieces rather than pieces in a strip form. All of these machines seem to employ a cutting section which includes a pair of parallel shafts mounted for rotation in opposite direction. The pair of shafts each support a plurality of cutting wheels for rotation therewith. Each of the cutting wheels mounted on one of the shafts is spaced from axially adjacent cutting wheels on the same shaft to closely receive one of the cutting wheels on the other shaft therebetween. Although these prior art devices employ the same overall configuration, the design of the cutting teeth or cutting surfaces on the cutting wheels are different. In each case the particular shape is intended to produce a transverse cut which results in the elongated strips being cut into smaller pieces as they pass between the rotating cutting wheels.

U.S. Pat. No. 3,860,180 entitled "Method And Apparatus For Destroying Documents" is intended to cut sheet paper material into elongated strips which are then transversely cut into smaller pieces. Specifically, the cutter rollers include a series of helically formed notches. The pointed trailing edge of each notch of the rotating rollers intersects or overlaps the outer periphery of the rollers on the other shaft during their rotation. Since the notches are helically formed, the helical angle should make propagation of the transverse cut of the paper material easier. However, a similar notch configuration would not be effective for the stiffer and tougher plastic material of bottles or metal of cans. Basically, with the formation of the initial edge cuts, those formed at the edges of the rollers, continued propagation of such edge cuts is likely as the strips are being formed. In other words, once edge cuts are produced, further propagation of the tougher plastic or metal of cans is likely so that only strips would be formed as the pointed edge of the trailing portion of the notch simply pushes rather than transversely cuts the stiffer and tougher material. FIG. 3 of U.S. Pat. No. 3,860,180 proportedly discloses the type of cutting produced by the machine. However, as will be seen in the Detailed Description hereinbelow, the actual cutting produced would be different for paper and, it is expected, that a transverse cut would not even be produced for the heavier, stiffer material of the disposable containers.

U.S. Pat. No. 4,260,115 entitled "Document Shredder" discloses a machine which again utilizes the basic cutting configuration and is intended to cut sheet waste material such as paper, cardboard, micofilm, plastic, rubber and leather. Again there is initial cutting at the edges of the discs in a direction corresponding to the movement of the sheet material through the cutters. Continued movement of the strips causes them to be pinched or cut transversely of the initial edge cuts between an engaging edge of a facing spacer member and the peripheral edge of the teeth of the cutting disc. However, there is no explanation of how more than one sheet might be cut and no explanation of how long the tolerances of this type of cutting disc can be maintained. It is expected that wear and tear of the edges would be significant for the tougher, thicker plastic or metal material of the disposable containers. It is clear from experimentation that thicker wall material as found in plastic bottles and metal cans could not be cut in this manner.

U.K. Pat. No. 2,118,065 A entitled "Waste Material Shredder" discloses a machine which is clearly intended to cut sheets of paper or cardboard as evidenced by the narrow gap between the spacer plates at the entrance to the cutting area. In order to produce a transverse cut in this machine, there is provided a leading face of a protrusion on one cutter disc which acts to guide the waste sheet material toward a tooth of the opposite cutter disc. The direction of relative movement is substantially perpendicular one to the other so that the point of the tooth is perpendicular to the sheet material. This proportedly produces a transverse cut of the sheet material. While such a transverse cut may occur with the thin, relatively weak sheet material to be used in this machine, it is not expected that such transverse cutting could be produced in the relatively heavy plastic or metal material. Experimentation with numerous teeth of a similar orientation has resulted in propagation of the edge cuts, those initially produced at the edges of the disc, and has resulted in an early formation of the strips as the pointed end of the teeth simply pushes the material rather than penetrating it for a transverse cut.

German Offenlegungsschrift DE 33 12 173 A1 is intended to cut sheet material. It is clear that the narrow gap between the spacer plates would only permit sheet material to be directed to the cutting discs. Again, as in U.S. Pat. No. 4,260,117, there is initially edge cutting at the edges of the cutting discs in the direction of movement between the cutting discs. However, an acutely pointed tooth on the disc proportedly pierces the sheet material to produce a transverse cut which, when combined with the initial edge cut, will produce small pieces of the material. As far as the design is concerned, it is extremely difficult to expect that such acute teeth would remain sufficiently sharp to produce a transverse cut on such heavy, stiff material as is used to produce the plastic bottles and metal cans. Again, there is some doubt that such an acute tooth, even if it were to remain sharp, would produce a transverse cut in such material. It is expected that the initial elongated cut at the edges of the discs would be propagated by the impact of the tooth so that no transverse cut would really be produced. The end of the tooth could simply push the sheet material so that the edge cut would simply propagated toward the tooth to cause the strip to be formed more quickly. Once in strip form, the strips would be free to move away from the end of the tooth so that there would not be sufficent resistence to produce any transverse cut.

Finally, U.S. Pat. No. 4,625,925 entitled "Commuting Apparatus For Sheet Material Or Sheet Material Layers" discloses a machine which is intended to cut one or more sheets of paper including plastic coated paper as well as plastic foils or the like. This machine again relies on a transverse cut at the peripheral edges of the teeth of the cutting disc. The teeth on one disc of a first shaft are aligned with the gap between the teeth of the overlapped discs of the other shaft. An examination of the teeth and how they intersect or overlap one another as they rotate reveals that the leading surface of one tooth is generally perpendicular to the teeth of the overlapping discs in the same manner as the leading face of the protrusion and the teeth of U.K. Pat. No. 2,118,065. There are more teeth on the disc of U.S. Pat. No. 4,625,925 so that smaller pieces, if they are in fact produced, would be expected. However, in any case, the cutting which might be produced in any material in such a machine would not be like that disclosed in FIG. 5 therein. While it is felt that the thicker, stronger material of plastic bottles and metal cans would not be cut in such a manner as might paper in the machine of U.S. Pat. No. 4,625,925, any effort to cut transversely will produce edge cuts in a manner different from those disclosed in the patent. This fact will be further discussed in the Detailed Description hereinbelow. It is again believed that the edge cuts, such as those produced in German Offenlegungsschrift DE 33 12 173 A1, would be propagated toward the peripheral edge of each tooth. Propagation of the edge cuts would tend to release the strips and allow them to move away from the point of the tooth to prevent the desired transverse cut.

Interestingly enough, all of these prior art devices employ the basic overlapping disc configuration to produce edge cuts. Additionally, all include a tooth or transverse cutting edge which may or may not produce the claimed transverse cut of sheet material which, in most cases, is made of paper or cardboard. As will be seen, the formal disclosures in the patents of the type of cuts produced by two of these machines are incorrect. Substantial experimentation with numerous similar tooth configurations have been conducted in an effort to transversely cut the disposable containers having the heavier wall material. As a result of these experiments, it is felt that none of the designs mentioned above would produce the desired smaller pieces of the heavier and stiffer plastic or metal material.

In addition to the difference in material that may cause a different result, there is a significant difference in the material configuration that can affect the efficiency and effectiveness of the cutting process. Although the disposable containers of the present invention are formed of thin wall material, it is not in sheet form. Because of the odd shape, it is not presented to the cutting disc in an orderly and aligned manner as can the sheet forms of material disclosed in the prior art machines. It is also most significant that there will never simply be one layer of the thin wall material to be cut.

Since the containers are bottles or cans, they typically must be "flattened" to be advanced between the cutting wheels. The feeding device of U.S. Pat. No. 4,703,899 tends to collapse or crush the containers to enable the teeth of the cutting wheels to grip them and draw them therebetween for cutting. Therefore, there will always be at least two layers of the thin wall material directly between the cutting wheels. In fact, since some plastic bottles are designed to include a separately formed and detached base of the plastic material, there can be as many as four layers simultaneously directed between the cutting wheels.

Still another complication exists for the cutting of disposable containers of the present invention that may not be present in the operation of any of the prior art machines. The soft drink liquid remaining in the disposable containers has been found in a short time of operation to completely engulf the interior of any container cutting machine. The liquid is extremely corrosive and the sugary substance can create even greater problems when heated. The friction created by the rotating cutting disc can produce a build up of solid, corrosive by-products that can seriously reduce the effectiveness and even the life of the machine.

Accordingly, it should not be surprising that the prior art machines for cutting sheet paper, etc., would not produce a transverse cut of several layers of thicker, heavier wall material of odd shaped articles in a sticky, corrosive environment. Any transverse cutting that these prior art machines might be able to produce in the material of the disposable containers would be limited and only for a relatively short period of operating time.

SUMMARY OF THE INVENTION

It is, therefore, an object of the present invention to provide a machine for cutting disposable containers such as plastic bottles and metal cans, which machine has a plurality of overlapping cutting discs which are capable of producing cuts at the edges of the discs and which include additional means for producing transverse cuts to cause the disposable containers to be cut into small pieces.

It is another object of the present invention to provide such a machine which is efficient and reliable and capable of sustained operation over an extended period of time.

These and other objects are found in a preferred embodiment of the invention which includes a machine capable of cutting into small pieces the thin wall material of a plurality of disposable containers such as plastic bottles and metal cans. The machine includes means for feeding in a first direction at least one of the disposable containers at a time to a cutting section. The cutting section includes a pair of parallel shafts which respectively have parallel center axes. The pair of shafts mounted for rotation in opposite directions about the center axes thereof. Each shaft rigidly supports a plurality of cutting wheels for rotation therewith. Each cutting wheel is mounted onone of the shafts to be spaced from axially adjacent cutting wheels thereon to closely receive one of the cutting wheels on the other shaft therebetween. Each cutting wheel has a maximum diameter and a plurality of cutting teeth thereon. Each cutting tooth has an apex at the maximum diameter of the cutting wheel and a root at a root diameter of the cutting wheel. The center axes of the shafts are separated by a distance therebetween which is less than the root diameter to produce a general overlapping of the cutting teeth on the one shaft and the cutting teeth on the other shaft therebetween as the cutting teeth move in the first direction. The cutting teeth are identical and evenly spaced about an outer periphery of the cutting wheel. Each cutting tooth has a leading surface and a trailing surface which meet at the apex to form a straight edge at the maximum diameter which is parallel with the center axis of the shaft. The leading surface and the trailing surface respectively lie in planes which are parallel with the center axis of the shaft and extend toward the same side thereof to cause the straight edge of the apex to circumferentially lead a remainder of the leading surface during the rotation of the cutting wheel. The cutting wheels on one shaft are angularly displaced from adjacent cutting wheels on the other shaft to cause general alignment of each cutting tooth of the one shaft between preceding adjacent cutting teeth and following adjacent cutting teeth on the adjacent cutting wheels on the other shaft prior to any overlapping thereof. The general alignment prior to the overlapping causes the thin wall material of the disposable container to be bent about the apex of each cutting tooth as a first, leading uncut portion of the thin wall material is entrapped between a leading surface of each cutting tooth and the trailing surfaces of the preceding adjacent cutting teeth of the other shaft and a second, trailing uncut portion of the thin wall material is entrapped between the trailing surface of each cutting tooth and the leading surfaces of the following adjacent cutting teeth of the other shaft. Each cutting tooth initially overlaps the preceding adjacent cutting teeth of the other shaft at the apex of the cutting tooth at the trailing surfaces of the preceding adjacent cutting teeth to cause the straight edge to produce a first, transverse cut of the thin wall material transverse to the first direction. Each cutting tooth further overlaps the preceding adjacent cutting teeth of the other shaft as side edges of the leading surface of the cutting tooth pass by adjacent side edges of the trailing surfaces of the preceding adjacent cutting teeth to produce a pair of second edge cuts of the thin wall material in a first direction extending from opposite ends of the first transverse cut. Each cutting tooth completely overlaps the preceding adjacent cutting teeth on the other shaft as the side edges of the leading surface of each cutting tooth completely pass by the adjacent side edges of the trailing surfaces of the preceding adjacent cutting teeth to complete the second edge cuts and produce the small pieces of the thin wall material.

DETAILED DESCRIPTION OF THE PREFERRED EMBODIMENTS

Figure 1:
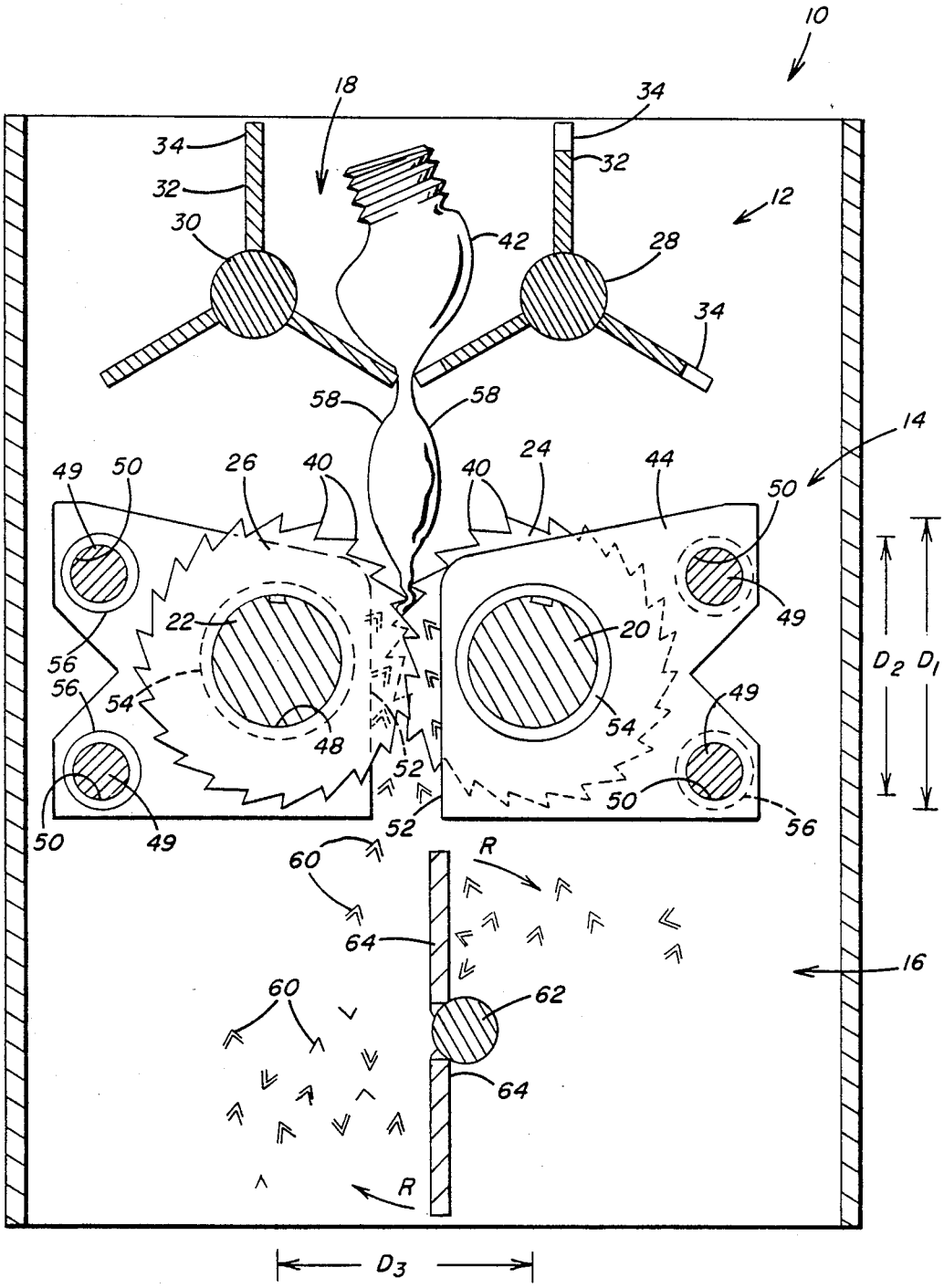
FIG. 1 is a sectional, elevation view of a preferred machine for cutting disposable containers including various features of the invention.

As seen in FIG. 1, the preferred machine 10 for cutting disposable containers includes a number of features identical to those disclosed in the patents incorporated by reference hereinabove and additional features which are similar to those in some of the patents incorporated by reference hereinabove. Basically, the preferred machine 10 includes a feeding section 12, a cutting section 14, and dispersing section 16 which is located above a collecting section (not shown). The feeding section 12 includes a feeding device 18 which is similar to the feeding device of U.S. Pat. No. 4,703,899. The feeding device 18 and cutting section 14 are driven in a manner similar to the feeding devices of U.S. Pat. Nos. 4,669,673; 4,729,515; and 4,703,899. A motor and reduction gear (not shown) drives one of the cutting shafts 20 of the cutting section 14 which is geared to and drives the other cutting shaft 22. A plurality of preferred cutting wheels 24, 26 are respectively keyed to and mounted on the shafts 20, 22 for rotation therewith. The adjacent cutting wheels 24, 26 on each shaft 20, 22 are separated by a cutting wheels 26, 24 on the other cutting shaft 22, 20. The overlapping cutting wheels 24, 26 are capable of cooperating to grip containers which are properly fed thereto. Once a container is gripped by the cutting teeth of the cutting wheels 24, 26, it is drawn between the rotating cutting wheels 24, 26 to be cut thereby.

To provide basic rotation to the feeding shafts 28, 30 of the feeding device 18, drive sprockets and chain drives associated with each cutting shaft 20, 22 respectively drive driven sprockets on the ends of the feeding shafts 28, 30. Consequently, clockwise rotation, as viewed in FIG. 1, of cutting shaft 22 produces relative clockwise rotation of the feeding shaft 30. Similarly, counterclockwise rotation of the cutting shaft 20 produces relative counterclockwise rotation of the feeding shaft 28.

Each of the feeding shafts 28, 30 includes three, evenly spaced paddles 32 having a plurality of teeth 34 at the extended edges thereof. The feeding device 18 of the machine 10 is substantially identical to the feeding device of U.S. Pat. No. 4,703,899 with one particular exception. Specifically, as will be discussed below, the driven sprockets (not shown) driving the feed shafts 28, 30 are larger to include more sprockets and result in a lower relative speed for feeding to the cutting section 14.

As mentioned, the basic overlapping and alternating configuration of cutting wheels 24, 26 of the preferred cutting section 14 is similar to the cutting sections disclosed in U.S. Pat. Nos. 4,669,673 and 4,729,515. Although additional details of the two cutting wheels 24, 26 will be discussed in detail hereinbelow, it is significant that each cutting wheel has a plurality of cutting teeth 40 thereon to have a maximum diameter D1 and a root diameter D2. The cutting shafts 20, 22 are separated by a distance D3 therebetween which is less than the root diameter D2 to produce a general overlapping of the cutting teeth 40 on the cutting wheels 24 of cutting shaft 20 with the cutting teeth 40 on the other cutting wheels 26 of the cutting shaft 22. The overlapping of the cutting teeth 40 occurs between the shafts 20, 22 as the teeth 40 move in a first direction corresponding to the movement of the container 42 between the shafts 20, 22.

The prior art cutting machines of U.S. Pat. Nos. 4,669,673 and 4,729,515 also included a plurality of combers, such as 44, 46, respectively mounted relative to the cutting shafts 20, 22. Each of the combers 44, 46 includes a major opening 48 therein for receipt of its respective cutting shaft 20, 22. Additionally, each of the combers is basically mounted at the end remote from the cutting region at a pair of rods 49 which extend through holes 50 in the combers. Each comber 44, 46 has its extended end 52 in general alignment with a cutting wheel 26, 24 of the opposite shaft 22, 20. The alignment between the combers 44 and the wheels 26 and between the combers 46 and the wheels 24 results in a gap therebetween which defines the major area of cutting by the cutting section 14.

The components as thus described are quite similar to those of the prior art cutting sections of U.S. Pat. Nos. 4,669,673 and 4,729,515. Generally, the cutting wheel and comber configurations in those machines are mounted for axial movement on the cutting shafts and the support rods. The support rods and the end walls of the machine generally establish the overall axial spacing of the prior art cutting machines. In other words, the cutting wheels of one shaft are separated from the other cutting wheels on the same shaft by the inter-positioning of the cutting wheels on the other shaft.

In the prior art machines, it was felt that the ability of the cutting wheels to move axially simplified production and assembly and further allowed a form of self-adjustment for the cutting of disposable containers between the adjacent edges of the overlapping cutting wheels. Clearly, for the type of machine disclosed in U.S. Pat. No. 4,729,515, it would be possible for numerous disposable containers to simultaneously be directed between the cutting wheels. The ability of the cutting wheels to shift or move axially was felt to enable the machine to effectively operate if a large number of containers were at one end of the array of cutting wheels and were soon followed by a number of containers being located at the other end of the array of cutting wheels. Since the combers were generally thinner than the cutting wheels, similar free axial movement of the combers was also allowed on the cutting shafts and the support rods.

However, for the preferred machine 10, the preferred cutting section 14 includes additional elements to prevent the type of free axial movement which was previously employed. The basic machine 10 includes a predetermined space between the opposite end walls so that the mounting area of the shafts 20, 22 and length of the support rods 49 is accurately defined. With the thickness of the cutting wheels 24, 26 being accurately defined during manufacture, accurate spacing is provided on each shaft 20, 22 by a plurality of spacer rings 54. In other words, each cutting wheel 24 on its shaft 20 is separated from an adjacent cutting wheel 24 by a spacer ring 54. Similarly, the cutting wheels 26 of shaft 22 are separated one from the other by spacer rings 54. The preferred spacer rings 54 are made of an acetal resin such as that sold under the trademarks DELRIN and CELCON. Such an acetal resin is employed because it has a relatively high modulus of elasticity and high strength and stiffness. Additionally, it has a low coefficient of friction with good abrasion and impact resistance. A spacer ring 54 can be made of such an acetal resin because of its excellent machinability. Its use in the machine 10 for cutting plastic bottles or metal cans from the soft drink industry is appropriate because of its low moisture absorption.

The well defined thickness of each spacer ring 54 clearly establishes the distance between the adjacent cutting wheels on one shaft so that the cutting wheels on the other shaft can be closely, snugly received therebetween. Close, sliding contact between the cutting wheels 24, 26 during rotation insures that the adjacent edges are maintained in close proximitely for clean edge cutting of the disposable containers cut therein. Maintaining the edges of the cutting wheels in such close proximity for them to slide one by the other for clean edge cutting will be discussed in detail hereinbelow.

Additionally, because of the array of cutting wheels 24, 26 and the associated spacer rings 54, free movement of the combers 44, 46 is no longer appropriate or desired. Consequently, a plurality of similar acetal resin rod spacers 56 are employed on the support rods 49 to maintain the thinner combers 44, 46 in position between the adjacent cutting wheels without allowing any contact therebetween. The prevention of contact between the combers 44, 46 and the cutting wheels 24, 26 has been found to minimize wear and possible damage of the cutting teeth 40. The cutting wheels 24, 26 should pass by each other sufficiently close to produce an effective edge cut of the container material. However, undesired contact between the cutting wheels 24, 26 and the combers 44, 46 which might decrease the effectiveness and life of the teeth is prevented by the rod spacers 56. Although the rod spacers 56 might be sufficient to provide overall protection for the teeth 40, the spacer rings 54 tend to prevent contact between the cutting wheels 24, 26 to further insure the teeth 40 remain undamaged and effective.

As thus described, the preferred machine 10 is capable of receiving a disposable container 42 in the upper portion thereof. The rotating paddles 32 of the feeding shafts 28, 30 grip and maintain the container 42 to feed it toward the cutting section 14. The teeth 40 of the rotating cutting wheels 24, 26 of the cutting section 14 grip and collapse the container 42 to draw it between the shafts 20, 22. Two or more layers of the thin wall material 58 of the container 42 is then cut into a plurality of small pieces 60 of the thin wall material by the cutting section 14. Again, the specific cutting and how it is produced will be discussed in detail below.

With the discharge of the small pieces 60 from the cutting section 14, one might expect that they could simply be collected in a collecting section (not shown) for eventual removal by store personnel. With the machine disclosed in U.S. Pat. No. 4,729,515, the pieces produced therein were elongated strips and were simply discharged from the cutting section to a collecting section. The elongated strips did not result in the smaller volume of material as is capable with the machine of U.S. Pat. No. 4,669,673 or the machine 10, but since the machine was under the constant attention of store personnel, it was simple to remove a bag or other device from the collecting section as the elongated pieces began to fill the collecting section.

For the machine of U.S. Pat. No. 4,669,673, the volume requirement of the collecting section is more critical and attention to the machine by store personnel need only occur if the collecting section is actually full. Accordingly, there was provided sensing means in the collecting section of the machine of U.S. Pat. No. 4,669,673 to indicate when the collecting section was full. A similar sensing means would be expected for the machine 10. Clearly, in order to properly fill the collecting section, it is desirable that the pieces produced by the associated machine are dispersed throughout the interior of the collecting section rather than being peaked in the center or simply located at one side thereof. Complete and accurate operation of the sensing means generally requires that the pieces produced by the cutting section be dispersed throughout the collecting section so that the actual height or level of pieces stored therein can be accurately measured. This was not a problem with the machine of U.S. Pat. No. 4,669,673 because the rotating blades of the second cutting section employed therein tended to evenly disperse and deposit the small pieces of material throughout the collecting section. As the material collected therein, the height or level of material was fairly uniform so that the sensing means accurately indicated when the collecting section was full.

However, with the preferred machine 10, the cutting of the smaller pieces occurs in the single cutting section 14 and has not been found to produce the type of dispersion of small pieces 60 for uniform collection within the collecting section. In other words, as the thousands and thousands of small pieces 60 were discharged from the cutting section 14 to a lower collecting section (not shown), the plurality of pieces began to simply stack up into a peaked or pointed mound of pieces. Stacking in this manner made sensing extremely difficult since the sensing means might indicate that the collecting section was full when in fact only the top portion or point of the pile of small pieces would be near the top of the collecting section. As a result, it has been found desirable to include a dispersing section 16 in the preferred machine 10 to disperse the plurality of small pieces 60 throughout the collecting section thereof.

One might assume that any number of forms of baffles or rotating or moving elements might be used to produce the desired relocating and dispersion of the small pieces throughout the interior of the collecting section. Some stationary baffles and some paddle or moving member configurations were not able to properly relocate the pieces throughout the entire area. Some simply relocated the pile or peaked collection in a different region of the collecting section. The preferred dispersing section 16 includes a rotating shaft 62 with a pair of dispersion paddles 64 mounted thereon. The shaft 62 is parallel with the cutting shafts 20, 22 and feed shafts 28, 30. Although an additional means may be employed to rotate the shaft 62, in the preferred machine 10, the shaft 62 is rotated by an additional drive sprocket and chain configuration on the cutting shaft 22 for relative corresponding rotation therewith. The shaft 62 is not located directly beneath the cutting area of the cutting section 14 but is displaced slightly toward and beneath the cutting shaft 20. With rotation as indicated by the arrows R, if the shaft 62 were located directly beneath the cutting area of the cutting section 14, the paddle 64 on the upper passage of rotation would tend to cause more of the small pieces 60 to be directed to the right as shown in FIG. 1. By displacing or locating the shaft 62 in a general direction toward the movement of the upper paddle 64, the upper paddle 64 is maintained directly below the cutting area of the cutting section 14 for a smaller fraction of a revolution of the shaft 62. In other words, by locating the shaft 62 toward rotation of the upper paddle, less of the small pieces 60 will be deflected by the closer, upper rotating paddle 64. With the upper paddle 64 in alignment directly below the small pieces 60 for a smaller amount of time, more of the smaller pieces 60 are able to fall further toward the collecting section for general alignment and dispersion by the lower paddle 64 on each revolution of the shaft 62.

To bring additional randomness into the dispersion of the small pieces 60, the paddles 64 are mounted on one side of the shaft 62. In other words, the actual amount of time and location of travel of the upper paddle 64 will slightly change on each half revolution. Similarly, the actual location and amount of time that the lower paddle 64 during rotation of the shaft 62 will be in general alignment of the falling pieces 60 will vary for each half revolution. In summary, the preferred dispersion section 16 includes a shaft 62 and paddle 64 configuration which tends to vary the time and location of the rotating paddles 64 in the path of the falling small pieces 60 to produce the desired type of random dispersion of the small pieces 60 which assures even distribution throughout the collecting section (not shown). Even dispersion of the small pieces 60 enables a sensing means to accurately determine when a relatively uniform, high level of small pieces 60 are in the collecting section so that it will accurately indicated when the pieces must be removed from the cutting section before continued cutting of additional containers.

Although the basic operation of the machine 10 as described hereinabove is important, the most important aspect of the present invention regards the manner in which cutting is produced by the preferred cutting teeth 40 of the cutting wheels 24, 26. The cutting teeth 40 of each cutting wheel 24, 26 are identical and evenly spaced about the outer periphery of the cutting wheels. Each cutting tooth 40 has a leading surface 66 and a trailing surface 68 which meet at the apex 70 of the cutting tooth 40 to form a straight edge at the maximum diameter D1 which is parallel with the center axes (not shown) of the cutting shafts 20, 22. The leading surface 66 and the trailing surface 68 respectively lie in planes which are parallel with the center axis of its respective cutting shaft 20, 22 and extend toward the same side of the center axis thereof. With the leading surface 66 and the trailing surface 68 extending along the same side of the center axis of their particular shaft 20, 22, the straight edge at the apex 70 will circumferentially lead a remainder of the leading surface 66 during the rotation of the cutting wheel 24, 26.

Figure 2:
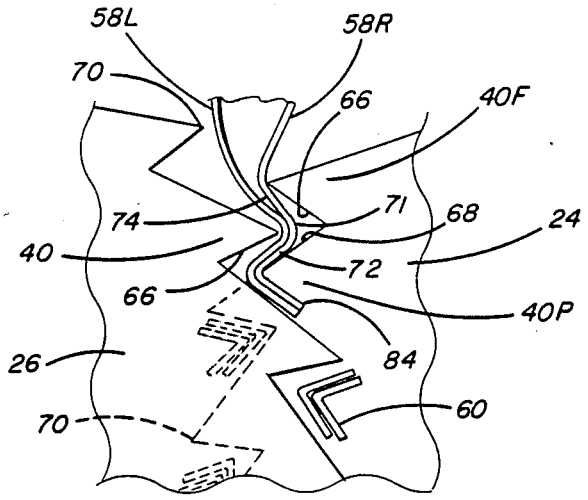
FIG. 2 is an enlarged, fragmentary view of the cutting wheels of the preferred machine.

As generally seen in FIG. 2, the cutting wheel 26 on the shaft 22 is angularly displaced from the adjacent cutting wheels 24 on the other cutting shaft 20 to cause general alignment of each cutting tooth 40 of the cutting wheel 26 between preceding adjacent cutting teeth 40P and following adjacent cutting teeth 40F of the adjacent cutting wheels 24 on the other shaft 20 prior to any overlapping of the teeth 40, 40P, 40F. In this position, the left layer of the thin wall material 58L and right layer of the thin wall material 58R are pressed together to be generally bent around the apex 70 of the cutting tooth 40. The bending around the apex 70 causes a first leading uncut portion 72 of the thin wall material 58L, 58R to be entrapped between the leading surface 66 of the tooth 40 and the trailing surfaces 68 of the preceding adjacent cutting teeth 40P. Additionally, a second, trailing uncut portion 74 of the thin wall material 58L, 58R is entrapped between the trailing surface 68 of the cutting tooth 40 and the leading surfaces 66 of the following adjacent cutting teeth 40F of the adjacent cutting wheels 24.

Figure 3:
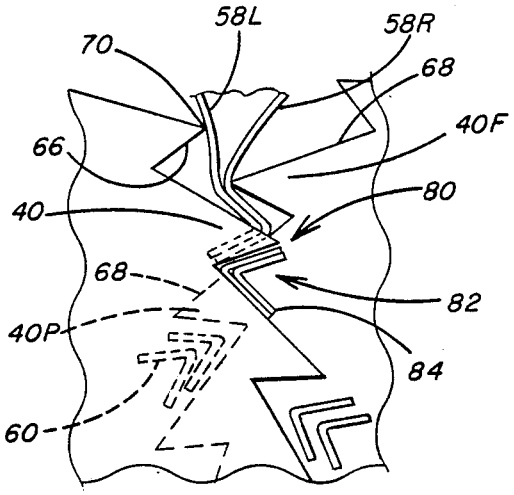
FIG. 3 is an enlarged, fragmentary view of the cutting wheels of FIG. 2 after further rotation of the cutting wheels.

As seen in FIG. 3, both cutting wheels 24, 26 have been slightly rotated from the position as shown in FIG. 2. In this position, the cutting tooth 40 has initially overlapped the preceding adjacent cutting teeth 40P of the other cutting wheels 24. The overlapping initially occurs at the apex 70 of the cutting tooth 40 and at the trailing surfaces 68 of the preceding adjacent cutting teeth 40P to cause the straight edge at the apex 70 to produce a first transverse cut 80 of surfaces 68 of the preceding adjacent cutting teeth 40P to cause the straight edge at the apex 70 to produce a first transverse cut 80 of the thin wall material 58L, 58R transverse to the first direction corresponding to general movement of the container between the cutting wheels 24, 26.

In fact, as shown in FIG. 3, each cutting tooth 40 has sufficiently overlapped the preceding adjacent cutting teeth 40P of the cutting wheels 24 of the shaft 20 to cause the side edges of the leading surface 66 of the cutting tooth 40 to pass by adjacent side edges of the trailing surfaces 68 of the preceding adjacent cutting teeth 40P. As the edges pass by one another, they produce a pair of second edge cuts of the portion 72 of the thin wall material 58L, 58R (better seen in FIG. 5) which edge cuts 82 are generally in the direction of movement through the cutting wheels 24, 26. The pair of edge cuts 82 respectively extend from opposite ends 86 of the first transverse cut 80.

Figure 4:
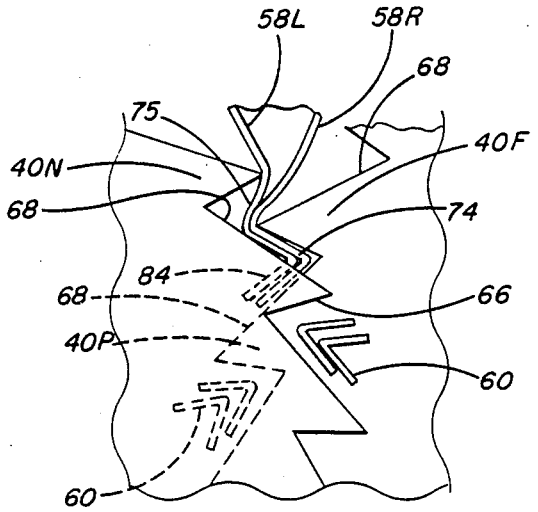
FIG. 4 is an enlarged, fragmentary view of the cutting wheels of FIGS. 2 and 3 after still further rotation of the cutting wheels.

As seen in FIG. 4, the cutting tooth 40 completely overlaps the preceding adjacent cutting teeth 40P of the cutting wheel 24. As a result, the side edges of the leading surface 66 of the cutting tooth 40 have completely passed by the adjacent side edges of the trailing surfaces 68 of the preceding adjacent cutting teeth 40P to complete the second edge cuts 82 to produce the small pieces 60 of the thin wall material 58L, 58R. Additionally, it can be seen that the following adjacent cutting teeth 40F are now located in general alignment between the trailing surface 68 of the cutting tooth 40 and the leading surface 66 of the next cutting tooth 40N of the cutting wheel 26. Again, the thin wall material 58L, 58R is bent about the apex 70 of each following adjacent cutting tooth 40F. Similarly, uncut portions of the thin wall material 58L, 58R are respectively entrapped between the trailing surface 68 of the cutting tooth 40 and the leading surfaces 66 of the following adjacent cutting teeth 40F and the trailing surfaces 68 of the following adjacent cutting tooth 40F and the leading surface of the next cutting tooth 40N. It should be clear that further rotation of the cutting wheels 24, 26 will produce a transverse cut at the apex 70 of each following adjacent cutting tooth 40F in the same manner as discussed hereinabove for the cutting tooth 40.

Figure 5:
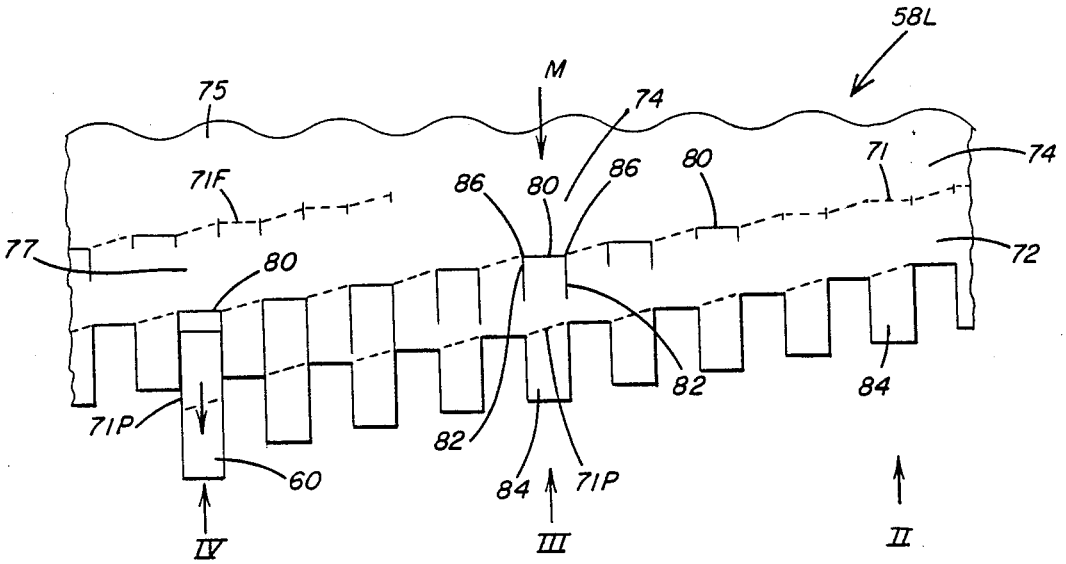
FIG. 5 is a fragmentary view of a portion of the thin wall material as cut by the cutting wheels of FIGS. 2 through 4.

As generally seen in FIG. 5, the thin wall material 58L is shown to provide a better understanding of the type of cutting which is produced by the cutting section 14. The thin wall material 58L is shown to be generally moving in the first direction M for movement between the cutting wheels 24, 26. The general inclined or progressive cutting as will be discussed hereinbelow, is produced by each cutting wheel 24, 26 being slightly angularly displaced on its respective shaft 20, 22 relative to the adjacent cutting wheels thereon. The slight angular displacement is preferably produced by the shafts 20, 22 being provided a helical groove or key way so that the cutting wheels 24, 26 are helically oriented relative to adjacent cutting wheels on the same shaft. The slight indexing or relative positioning of the cutting wheels 24, 26 allows a form of staggered cutting which is easier on the drive motor and reduction gear mechanism and tends to even out the work load thereon. This helical or spiral configuration is not new and is found in the prior art machine of the Patents mentioned hereinabove which are incorporated herein by reference and in various other machines of the prior art.

As a result, although the positioning of the cutting tooth 40 varies in FIGS. 2, 3 and 4, the same type of cutting produced by the cutting tooth 40 can be shown in different axial positions along the thin wall material 58L. Specifically, the portion II of the thin wall material 58L of FIG. 5 generally represents the positioning and condition of the thin wall material 58L as seen adjacent the cutting tooth 40 in FIG. 2. Similarly, the portion III of the thin wall material 58L represents the condition of the thin wall material 58L adjacent the cutting tooth 40 in FIG. 3. The portion IV of the thin wall material 58L of FIG. 5 represents the region thereof adjacent the cutting tooth 40 of FIG. 4.

Generally, as seen in FIG. 5, the dashed line represents bent or folded areas of the thin wall material 58L. As seen at portion II there is bending 71 at the apex 70 of the cutting tooth 40. The uncut portion 72 and 74 are located on each side of the bent area 71. It should now be noted that there is also a tab or half 84 of a small piece 60 adjacent to the uncut portion 72. This half 84 can be seen in FIGS. 2 and 3 and represents the portion of the sheet material 58L which remains after the removal of the preceeding small pieces 60 of the thin wall material 58L.

Between the portion II and the portion III of the thin wall material 58L, there is a transverse cut 80 formed by an apex 70 as it initially pierces the thin wall material 58L. The position of the cutting tooth 40 of FIG. 3, as shown in the portion III, has already resulted in the formation of the transverse cut 80 and partial formation of the edge cuts 82 between the edges of the leading surface 66 of the cutting tooth 40 and the trailing surface 68 of the preceding adjacent cutting tooth 40P. It should now be clear how the edge cuts 82 are formed from the opposite ends 86 of the transverse cuts 80. Additionally, it should be noted that an uncut portion 74 of the thin wall material 58L remains uncut after the formation of the transverse cut 80 and throughout continued cutting of the edge cut 82. It should also be noted that each of the halves 84 basically joins the remainder of the thin wall material 58L at a bent region 71P which was formed during the general bending about the apex 70 of the preceding adjacent cutting teeth 40P.

As seen at portion IV of the thin wall material 58L, the small piece 60 has been formed. The small piece 60 is formed to include the bent region 71P and is free to move from the remainder of the thin wall material 58L. It should also be noted that there is already formation of another bent region 71F by the apex 70 of the following adjacent cutting tooth 40F. The uncut portion 72 is between the bent region 71F and the transverse cut 80 which allowed eventual release of the small piece 60. The similarity between the portion II and the portion IV should show that the cutting produced by the cutting wheel 40 will be duplicated for the following adjacent cutting tooth 40F and each cutting tooth thereafter.

It should be pointed out that the type of cutting produced by the cutting wheels 24, 26 is not expected to produce the propagation of edge cuts which will be discussed hereinbelow for the prior art machines. Specifically, as one cuts at the edges of cutting wheels, one might expect that the edge cuts of the heavier, stiffer material of the disposable containers could be propagated to result in only strips being formed rather than a transverse cut. However, with the arrangement of the cutting wheels 24, 26 of the preferred machine 10, the transverse cut is initially produced while the cutting teeth ridgedly hold and secure the uncut portions 72, 74 on either side thereof. By inital formation of the transverse cut while the uncut portions 72, 74 are being retained, there is not an opportunity for any edge cuts to be formed or for any propagation of edge cuts previously formed. Propagation tends to occur if any edge cut is unbounded. In other words, any edge cut which is free to continue up the thin wall material 58L might continue by propagation. As the transverse cut 80 is initially being formed, there is no overlapping of the cutting teeth in any other region to produce edge cuts in the uncut portions 72, 74. The overlapping which next occurs is at the edge cuts 82 in a direction M toward the previously cut region of the thin wall material 58L so they are not inclined to propagate in the opposite direction toward the uncut portion 74. When an edge cut 82 is bound in this manner by the transverse cut 80 and the opposite ends 84 thereof, there is a release of tension in the uncut portion 74 so that propagation into the uncut portion 74 will not occur.

An overall view of the type of cutting produced by the preferred machine 10 in FIG. 5 may lead one to believe that the same type of cutting is produced by one or more of the prior art Patents mentioned above. In order to fully understand the differences in the preferred machine 10 and those taught in the prior art, a detailed explanation of several of these prior art machines is in order.

Figure 6:
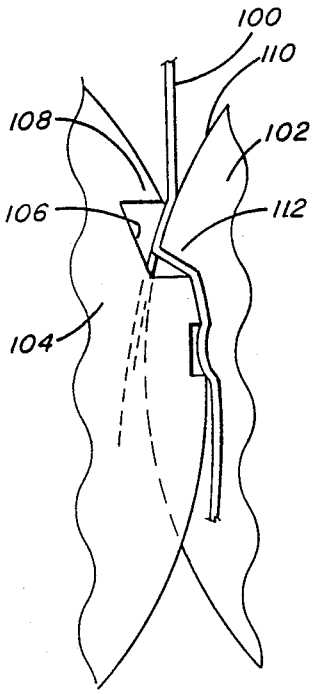
FIG. 6 PRIOR ART
FIG. 6 is an enlarged, fragmentary view of the cutting region of a prior art cutting machine.

As seen in FIG. 6, the cutter roller configuration of U.S. Pat. No. 3,860,180 includes a document 100 which is being cut by overlapping cutter rollers 102, 104. The cutter rollers 102 rotate in a counter-clockwise direction while the cutter rollers 104 rotate in a clockwise direction. Each of the cutter rollers 102, 104 include a series of helically formed notches 106, although only the notch 106 on roller 104 is in a position to be seen in FIG. 6. The relative position of the cutter roller 102 and the cutter roller 104 is such that the pointed trailing edge 108 of the notch 106 or cutter roller 104 is about to overlap the peripheral edge 110 of the cutter roller 102. The document 100 has a lower portion 112 which is already in strip form by the overlapping action of the edges of the cutter roller 102 and the cutter roller 104 prior to the notch 106 being positioned for overlapping relationship with the cutter roller 102.

Figure 7:
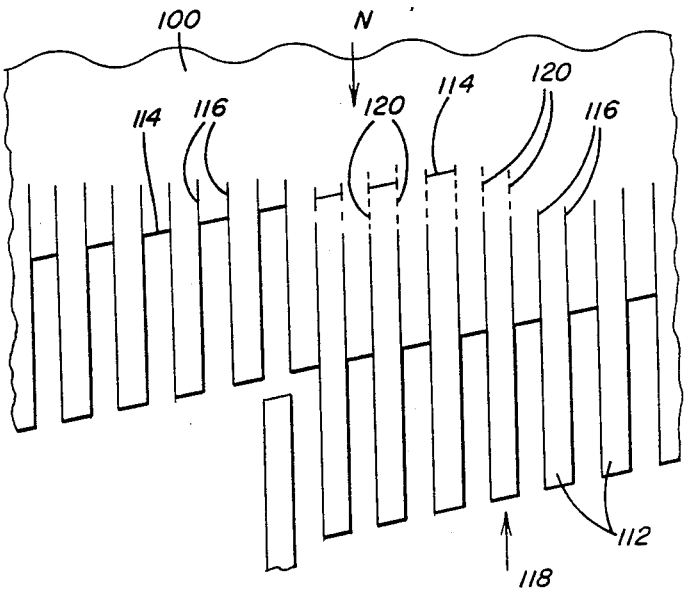
FIG. 7 PRIOR ART
FIG. 7 is a fragmentary view of a portion of the material cut in the machine of FIG. 6.

As seen in FIG. 7, the document 100 moves in a direction indicated by the arrow N. It should be noted that the view of the FIG. 7 is similar to the view of the document in U.S. Pat. No. 3,860,180 in FIG. 3 thereof, with the exception that the view is rotated 180 degrees for a better understanding of the type of cutting which is produced. Basically, the view of the document 100 in FIG. 7 includes the transverse cuts which are generally helical and supposedly produced by the pointed trailing edge 108 of the notch 106. Additionally, the overlapping relationships of the cutter rollers 102, 104 would produce edge cuts 116 to basically form the strips 112 as mentioned above. Specifically, the portion of the document 100 shown in FIG. 6 would correspond to the portion 118 of FIG. 7. Further rotation of the cutter rollers 102, 104 would produce the general cutting of the edges 116 and transverse cut 114 as viewed to the left of the portion 118. Again, depending on the type of sheet material of which the document 100 is made, the machine of FIG. 6 and FIG. 7 (the machine of U.S. Pat. No. 3,860,180) may be capable of producing the strips as shown therein.

However, if the heavier, stiffer material of the disposable containers were to be cut in such a cutter roller configuration, it is felt that propagation of the edge cuts 116 would occur to prevent the transverse cuts 114 from ever being formed. Specifically, FIG. 7 includes dotted lines 120 representing the expected area of propagation if the material of the disposable containers were to be cut by such a cutter roller configuration. This propagation at 120 would be expected to occur because of the unbound nature of the edge cuts 116 produced. Basically, there is nothing to prevent the edge cuts 116 from moving further up the document 100 under the force created by the pointed trailing edge 108 as it pushes the document 100 against the peripheral edge 110 of the cutter roller 102. It should be clear that the edge cuts 116 produced therein are not prevented or discouraged from propagation by an initially produced transverse cut. Without a previously formed transverse cut, there is nothing to prevent the pushing created by the pointed trailing edge 108 from simply forcing a propagation at 120 rather than there being sufficient resistance at the edges to insure that a transverse cut 114 will be formed.

Figure 8:
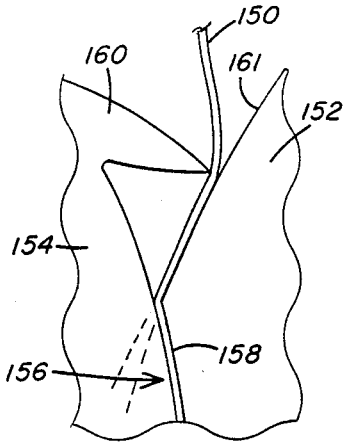
FIG. 8 PRIOR ART
FIG. 8 is an enlarged, fragmentary view of the cutting region of a second prior art cutting machine.

As seen in FIG. 8, the sheet material 150 is to be cut by the cutting discs 152, 154 of the machine as disclosed in the German Offenlegungsschrift DE 33 12 173 A1. As shown, the cutting discs 154 and 152 are overlapped to initially produce edge cuts 156 to form lower stripped portions 158 of the sheet material 150. Additionally, the acutely pointed tooth 160 of the cutting disc 154 is being aligned for overlapping relationship with the peripheral edge 161 of the cutting disc 152.

Figure 9:
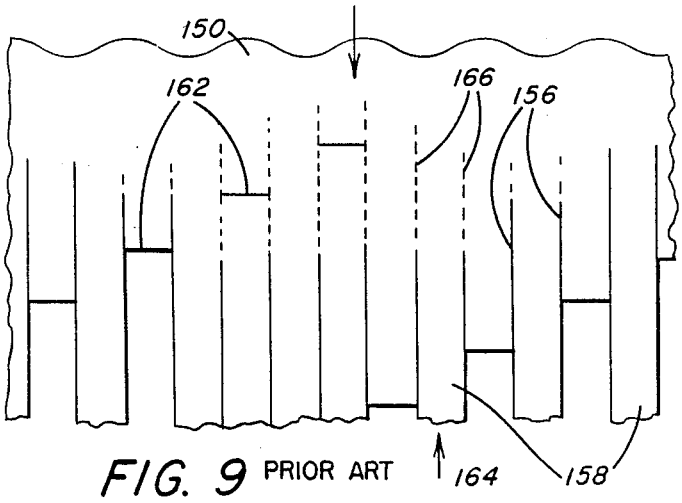
FIG. 9 PRIOR ART
FIG. 9 is a fragmentary view of a portion of the material cut in the machine of FIG. 8.

As seen in FIG. 9, the sheet material 150 is moving through the array of cutting discs 152, 154 of this German machine in a direction as indicated by the arrow O. With the acutely pointed tooth 160 of the cutting disc 154 not yet forming a transverse cut 162, the portion of the sheet material 150 of FIG. 9, which represents the material as seen in FIG. 8, is the portion 164 just prior to the formation of a transverse cut 162. Again, the transverse cut 162, the edge cuts 156 and the resulting strips 158 which are formed thereby are shown in FIG. 9 for the type of sheet material which could be cut in a transverse manner therein. However, FIG. 9 also includes the dotted lines 166 to represent the propagation of the edge cuts 156 which could occur with the heavier, stiffer material of the disposable containers if one were to attempt to use such a machine for cutting disposable containers. With the tooth 160 being brought against the thin wall material of a disposable container as at the portion 164, the force on the thin wall material just prior to overlapping which might produce a transverse cut 162 would tend to push the thin wall material adjacent the strips 158 so that the edge cuts 156 would be propagated as seen at 166. Propagation of the edge cuts 156 would enlarge the strips 158 and prevent any transverse cut 162 from being formed. Since the stiffer wall material of the disposable containers would be free to propagate, the formation of the strips through the propagation at 166 would simply cause the strips 158 to be pushed by the pointed tooth 160 rather than there being sufficient support for or resistance at the edge cuts of the wall material for a transverse cut 162 to be formed.

Figure 10:
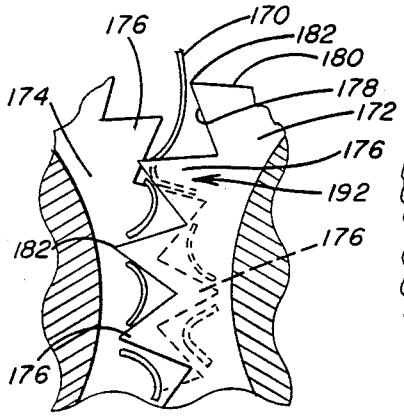
FIG. 10 PRIOR ART
FIG. 10 is an enlarged, fragmentary view of the cutting region of a third prior art cutting machine.

As seen in FIG. 10, one or more layers of sheet material 170 is directed between the overlapping array of cutting discs 172, 174 of the machine disclosed in U.S. Pat. No. 4,625,925. Each cutting disc 172, 174 includes a plurality of teeth 176. The teeth 176 are identical and include leading surfaces 178 and trailing surfaces 180 which meet at the periphery of the cutting disc 172, 174 at the apex 182 of each tooth 176. The general overlapping arrangement of the cutting discs 172, 174 produces the edge cuts 184 between the adjacent edges of the overlapping teeth 176. Additionally, the machine of U.S. Pat. No. 4,625,925 is intended to produce a transverse cut as the sheet material 170 is forced over the apex 182 of a cutting tooth 176 of the cutting disc 172 by the leading surface 178 of a tooth 176 on the other cutting disc 174.

Figure 11:
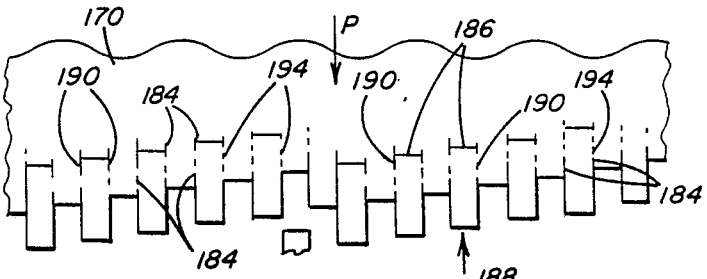
FIG. 11 PRIOR ART
FIG. 11 is a fragmentary view of a portion of the material cut in the machine of FIG. 10.

As seen in FIG. 11, the sheet material 170 is generally caused to move in a direction as indicated by the arrow P through the machine of U.S. Pat. No. 4,625,925. Assuming that the machine generally operates as taught therein, the overlapping operation of the cutting discs 172, 174 and the teeth 176 thereof would produce numerous edge cuts 184 followed by a series of transerve cuts 186. It should be noted that the view in FIG. 11 of the sheet material 170 is intended to be similar to the view of such material in FIG. 5 of U.S. Pat. No. 4,625,925. Again, the material in FIG. 11 is rotated 180 degrees for ease of viewing. However, it should be noted that there are other differences in the views of FIG. 11 herein and FIG. 5 of U.S. Pat. No. 4,625,925. Specifically, in FIG. 5 of that patent, all of the series of edge cuts disclosed therein appear to be bounded by transverse cuts. A close analysis of the tooth arrangement of the cutting discs 172, 174 reveals that such limited edge cutting would not be possible. The portion 188 of the material 170 of FIG. 11 represents the condition that exists in FIG. 10. The leading surface 178 of a tooth 176 on the cutting disc 174 has pushed the material 170 over the apex 182 of a tooth 176 of the cutting disc 172. Pushing the material over the apex 182 produces the transverse cut 186. It also causes edge cutting 190 from the opposite ends of the transverse cuts 186 in the direction P of flow through the machine. A view of FIG. 5 in the prior art patent would indicated that only such edge cutting is produced.

If this were true, the cutting shown in FIG. 5 of the prior art patent would be accurate and the prior machine would appear to operate in the same manner as machine 10. However, an examination of the relationship of the overlapping cutting teeth 176 indicates that additional edge cutting 184 must be produced in a direction opposite from the direction P of flow through the machine. An examination of the relationship of the cutting teeth 176 of the cutting discs 172, 174 indicates that there may very well be some small edge cutting 190 occuring adjacent the transverse cut 186. However, there is no doubt that the most significant edge cutting 184 occurs in the direction opposite from the direction P of flow through the machine because of the significant overlapping of the leading surface 178 of each tooth 176 as it passes closely by the trailing surface 180 of the preceding adjacent cutting tooth 176 on the other cutting disc. This condition is clearly seen in FIG. 10 at 192.

With the edge cuts 184 being unbounded, there is again expected to be propagation 194 of the edge cuts 184. Such propagation would prevent the cutting configuration as seen in FIG. 10 from being capable of producing any transverse cut 186 of the material of the disposable containers as intended in the present invention.

The differences in the machine 10 of the present invention and those of the prior art, as shown in FIGS. 6, 8 and 10, clearly exists in the design and relationships of the teeth of each. With the teeth of the prior art devices, there is no bending of the sheet material disclosed therein as occurs around the apex 70 of the teeth 40 of the machine 10. There is no bending in these prior art devices because none of the teeth configuration are capable of entrapping uncut portions of the material to be cut thereby between leading surfaces of one tooth and the trailing surface of the immediately preceding tooth. Entrapping the uncut portions of the material on both sides of a particular tooth produces the bend around the point thereof and basically supports the thin wall material in a condition for eventual transverse cutting. Failure to have the entrapment and the bending allows propagation to occur since the previously formed edge cuts are not bounded by any entrapment or bending. It should be understood that it is not claimed herein that no material can be cut transversely by the prior art devices of FIGS. 6, 8 and 10. However, the heavier, thicker material of the disposable containers has been found to be particularly susceptible to propagation if edge cuts are originally provided in a manner which does not discourage or prevent their propagation of the thin wall material of the disposable containers.

By contrast, the machine 10 includes an alignment of teeth 40 which insures that an uncut portion of the thin wall material (one having no unbounded edge cuts) is entrapped between the leading surface of a tooth and trailing surfaces of immediately preceding teeth of the other wheels. Further entrapment of an uncut portion against the trailing surface of a tooth and leading surfaces of the next teeth on the other cutting wheels insures positive bending of the thin wall material around the apex of the tooth. When both uncut portions of the material are entrapped in this manner against the leading surface and the trailing surface of a tooth the apex is in a position for initially producing the transverse cut. Only after the transverse cut is initiated will edge cutting be produced at the ends of the transverse cut. These edge cuts are bounded by the transverse cut so that continued propagation of the thin wall material will not occur.

An additional feature of the machine 10 includes the fact that after the thin wall material is bent around the apex of one tooth, the apex of the next following tooth is being brought into position to partially grip or prevent additional movement of the thin wall material at the apex of the following tooth on the other cutting wheel. Partial restriction and preliminary gripping of the thin wall material at the apex 70 of the tooth 40F of FIGS. 2, 3 and 4 shows how additional restriction of the thin wall material is provided to further insure that the thin wall material will remain in position for transverse cutting. One feature of the machine 10 mentioned above has been included to help insure that the apex 70 of the following adjacent cutting tooth 40F will tend to grip and restrict the movement of the thin wall material 58L, 58R as the transverse cut is being produced by the apex 70 of the cutting tooth 40. The paddle configuration of the feeding assembly of the device in U.S. Pat. No. 4,703,899 employed drive and driven spoke configurations which resulted in the cutting shaft rotating only slightly faster than the feed shafts. Since the drive sprocket to driven sprocket ratio was 11 to 13, the cutting shaft rotated 13 times for every 11 rotations of the feed shaft. Since the radius of the paddles was slightly larger than the radius of the cutting wheels of the machine of U.S. Pat. No. 4,703,899, the general speed of the container through the feed section and through the cutting section were about the same.

However, in order to insure there is positive gripping of the plurality of teeth 40 of the present invention which will result in the transverse cut, the drive sprocket to driven sprocket ratio of the feeding device 18 of the machine 10 has been altered to include a tooth ratio of 11 to 20. In other words, the cutting wheels will rotate about twice as fast as the feed paddles to insure positive gripping and bending thereby which results in a preferred positioning of the material so that the transverse cuts can be produced. As a result of this slower feeding speed when compared to the speed of the cutting wheels 24, 26 it can be seen that the early bending and gripping of the thin wall material 58L, 58R will indeed occur at the apex 70 of the following adjacent cutting teeth 40F.

With the basic design of the preferred machine 10 having been explained, it is appropriate to recognize the wide variety in sizes of the plastic bottles which must be received and cut in such a machine. Four plastic bottle sizes are presently employed in the soft drink industry to meet the varying demands of customers. A half liter or pint bottle has a height of about 7 inches and a width of about $2\frac{3}{4}$ inches. A one liter bottle has a height of about 11 inches and a width of about 3 inches. A two liter bottle has a height of about 12 inches with a width of about $4\frac{1}{2}$ inches. Finally, three liter bottles have a height of about 13 inches and a width of about 5 inches. While these dimensions are only approximate and vary for different bottles of the same size from different manufacturing sources, they do serve as examples of the wide range of sizes and dimensions which may be required to cut in an acceptable reverse vending machine. It should also be recognized that a similar variety of metal cans might be employed in a reverse vending machine. It has been found that a reverse vending machine employing the preferred cutting section of the type described will accept and cut various sizes of metal cans if it is capable of accepting the above-described plastic bottles. Typically, the thickness of the plastic forming the thin wall material of the plastic bottles ranges from about 12/1000th of an inch to about 35/1000th of an inch. The thin aluminum material used for the walls of metal cans is about 10/1000th of an inch thick.

Additionally, specific dimensions and characteristics for the preferred machine 10 should be provided to enable one to more clearly and accurately understand the preferred machine 10 and how it is capable of properly cutting a plurality of plastic bottles and/or metal cans therein. The machine 10 used in a reverse vending machine typically includes 27 cutting wheels with 14 cutting wheels on one shaft and 13 cutting wheels on the other. The entire array of cutting wheels is 8 inches long. Each of the 8 inch cutting shafts is induction hardened to 50 Rc to a depth of about ⅛ inch. The cutting shafts have a diameter of 2.150 inches and are each provided a spiral or helical groove covering a range of between 40 and 45 degrees of the circumference over the eight inch length. When installed in the machine 10, the distance between the cutting shafts is about 4.010 inches.

The preferred cutting wheels are formed of D-2 tool steel having a hardness of at least 55 Rc. Each cutting wheel has a maximum diameter of 4.875 inches (preferably less than 5 inches) and a root diameter of 4.188 inches (preferably greater than 4.125 inches). Each of the cutting wheels has a width of about 0.295 inches (preferably less than 0.3 inches) with a hole having a 2.156 inch diameter therethrough for mounting of the cutting shafts. The wheels are provided a detent in the hole for the receipt of a steel ball which is received in the helical groove of the shaft as the cutting wheel is mounted thereon. The steel ball prevents undesired rotation if each cutting wheel on its cutting shaft. From the information provided above, it should be clear that the cutting wheels have an overlap of about 0.865 inches (preferably between ¾ of an inch and one inch) in the area directly between the centers of the cutting shafts.

The preferred cutting wheels have 24 identical cutting teeth. The approximate distance between the apex of each cutting tooth on the cutting wheel is about 0.625 inches and each cutting tooth has a height of about 0.344 inches (preferably between about 0.25 inches and about 0.50 inches). The angle of each tooth at the apex is about 45 degrees (within about 40 degrees to about 50 degrees) and the root angle between adjacent teeth is about 60 degrees (within about 55 degrees to about 65 degrees). As mentioned above, each of the leading surface and the trailing surface extend toward the same side of the center axis of the cutting shaft. Specifically, in order to allow the cutting edge at the apex to proceed the remainer of the leading surface, the leading surface is at an angle of about 5 degrees to 10 degrees with a radius extending from the center axis of the shaft through the apex as the leading surface extends from the apex in a circumferential direction opposite from the direction of rotation. The trailing surface would thus be at about 50 to 55 degrees with the same radial line in the same circumferential direction as both the leading surface and the trailing surface extend to the same side of the center axis of the cutting shaft. Because of the alignment between the leading surface of one tooth and the trailing surface of the adjacent preceding tooth on the other shaft, it is significant to note that the angle between the leading surface of one tooth as the apex thereof is aligned with the trailing surface on the immediately preceding tooth of the other shaft is about 10 degrees to 20 degrees. Preferably, this angle should be about 15 degrees and such an angle would clearly allow the thin wall material to be entrapped between the leading surface of the one tooth and the trailing surface of the preceding tooth so that a transverse cut can be made prior to the edges passing one by the other to produce the edge cuts. In the preferred machine 10, the general alignment just prior to overlapping of the apex with the trailing edge occurs with the cutting tooth at an angle of about 25 to about 30 degrees from a line between the centers of both cutting shafts.

The acetal spacer rings to be installed between the cutting wheels on the cutting shaft have a width of about 0.295 inches, an outside diameter of about 2.45 inches and an inside diameter of about 2.157 inches. The combers have a width of about 2.50 inches and are maintained in alignment by the rod spacers having a width of about 2.336 inches.

With the machine 10 being provided the components as described above, each plastic bottle is cut into many hundreds or thousands of pieces as it passes through the cutting section. Although the sizes may vary because of the multiple layers being cut at the same time in the cutting section, the small pieces would typically be about 0.3 inches wide and have a longer dimension with a crease or bend in the middle thereof which is about 0.7 inches. In a controlled test of an experimental model of the preferred machine 10, 500,000 plastic bottles were satisfactorily cut therein requiring only routine maintenance and produced only normal wear on the components but without any failure of the machine or the essential components thereof.

While the preferred embodiment of the invention has been described above, it should be clear that numerous alterations of the preferred embodiment could be made without departing from the scope of the invention as claimed.

What is claimed is:

1. A machine capable of cutting into small pieces the thin wall material of a plurality of disposable containers such as plastic bottles or metal cans comprising:

means for feeding in a first direction at least one of said disposable containers at a time to a cutting section;

said cutting section including a pair of parallel shafts;

said parallel shafts respectively having parallel center axes;

said pair of shafts being mounted for rotation in opposite directions about said center axes thereof;

each of said pair of shafts rigidly supporting a plurality of cutting wheels for rotation therewith;

each said cutting wheel being mounted on one of said shafts to be spaced from axially adjacent said cutting wheels thereon to closely receive one of said cutting wheels on the other of said shafts therebetween;

each said cutting wheel having a maximum diameter and a plurality of cutting teeth thereon;

each said cutting tooth having an apex at said maximum diameter and a root at a root diameter of said cutting wheel;

said center axes of said shafts being separated by a distance therebetween which is less than said root diameter to produce a general overlapping of said cutting teeth of said cutting wheel on said one shaft and said cutting teeth of said cutting wheel on said other shaft therebetween as said cutting teeth move in said first direction;

said cutting teeth being identical and evenly spaced about an outer periphery of said cutting wheel;

said each cutting tooth having a leading surface and a trailing surface which meet at said apex to form a straight edge at said maximum diameter which is parallel with said center axis of said shaft;

said leading surface and said trailing surface respectively lying in planes which are parallel with said center axis of said shaft and extend toward the same side thereof to cause said straight edge of said apex to circumferentially lead a remainder of said leading surface during said rotation of said cutting wheel;

said cutting wheels on said one shaft being angularly displaced from adjacent said cutting wheels on said other shaft to cause general alignment of said each cutting tooth of said one shaft between preceding adjacent said cutting teeth and following adjacent said cutting teeth of said adjacent cutting wheels on said other shaft prior to any overlapping thereof;

said general alignment prior to said overlapping causing said thin wall material of said disposable container to extend about said apex of said each cutting tooth as a first, leading uncut portion of said thin wall material is disposed between said leading surface of said cutting tooth and said trailing surfaces of said preceding adjacent cutting teeth of said other shaft;

said each cutting tooth initially overlapping said preceding adjacent cutting teeth of said other shaft at said apex of said each cutting tooth at said trailing surfaces of said preceding adjacent cutting teeth to cause said straight edge to produce a first transverse cut of said thin wall material transverse to said first direction;

said each cutting tooth further overlapping said preceding adjacent cutting teeth of said other shaft as side edges of said leading surface of said each cutting tooth pass by adjacent side edges of said trailing surfaces of said preceding adjacent cutting teeth to produce a pair of second edge cuts of said thin wall material in said first direction extending from opposite ends of said first transverse cut; and said each cutting tooth completely overlapping said preceding adjacent cutting teeth as said side edges of said leading surface of said each cutting tooth completely passes by said adjacent side edges of said trailing surfaces of said preceding adjacent cutting teeth to complete said second edge cuts to produce said small pieces of said thin wall material.

2. The machine as set forth in claim 1, wherein said general alignment prior to said overlapping causes thin wall material of said disposable container to be bent about said apex to cause said first, leading uncut portion of said thin wall material to be entrapped between said leading surface of said cutting tooth and said trailing surfaces of said preceding adjacent cutting teeth on said other shaft and further including a second, trailing uncut portion of said thin wall material being entrapped between said trailing surface of said each cutting tooth and said leading surfaces of said following adjacent cutting teeth of said other shaft.

3. The machine as set forth in claim 1, wherein said each cutting tooth includes said trailing surface being greater than twice as long as said leading surface as each extends between said root diameter and said maximum diameter.

4. The machine as set forth in claim 1, wherein said apex has an angle of about 40 degrees to about 50 degrees.

5. The machine as set forth in claim 1, wherein said each cutting tooth at said general alignment prior to said overlapping is located on said shaft at a positional angle from about 25 degrees to about 30 degrees from a line extending between said shafts.

6. The machine as set forth in claim 1, wherein said leading surface of said each cutting tooth at said general alignment prior to said overlapping is at an intersect angle of about 10 degrees to about 20 degrees with said trailing surfaces of said preceding adjacent cutting teeth.

7. The machine as set forth in claim 1, wherein said each cutting wheel is made of D-2 tool steel having a hardness of at least 55 Rc.

8. The machine as set forth in claim 1, wherein said each cutting wheel has a width of less than about 3/10 of an inch.

9. The machine as set forth in claim 1, wherein said maximum diameter is less than 5 inches, said root diameter is greater than $4\frac{1}{8}$ inches, and said each cutting tooth has a height between said root and said apex thereof of between about $\frac{1}{4}$ inch and about $\frac{1}{2}$ inch.

10. The machine as set forth in claim 1, wherein said center axes of said shafts are about 4 inches apart and said overlapping of said cutting wheels on said one shaft with said cutting wheels on said other shaft is between $\frac{3}{4}$ of an inch and 1 inch.

11. The machine as set forth in claim 1, wherein said leading surface extends from said apex in a circumferential direction opposite from a direction of rotation to form an angle of about 5 degrees to about 10 degrees with a radial line from said center axes of said shaft through said apex.

12. The machine as set forth in claim 1, wherein said each of said cutting wheels includes about 24 of said cutting teeth.

13. The machine as set forth in claim 1, further including a collecting section beneath said cutting section including a means for dispersing said small pieces of said thin wall material being cut by said cutting section to produce a relatively even distribution of said small pieces collecting within said collecting section.

14. The machine as set forth in claim 13, wherein said means for dispersing said small pieces includes paddle means mounted on a paddle shaft below said cutting section, said paddle shaft being generally parallel to said shafts and rotating to cause said paddle means thereon to make contact with said small pieces from said collecting section for distribution throughout said collecting section.

15. A method of cutting into small pieces the thin wall material of at least one disposable container such as a plastic bottle or metal can between overlapping cutting wheels respectively mounted for rotation in opposite directions on two parallel shafts, adjacent first said cutting wheels on a first of said shafts being separated one from another as a second cutting wheel on a second of said shafts extends therebetween, said first cutting wheels and said second cutting wheels being identical and including a plurality of cutting teeth thereon, said method comprising the steps of:

feeding said disposable container in a first direction toward said first cutting wheels and said second cutting wheels;

collapsing said disposable container by said first cutting wheels and said second cutting wheels as said disposable container is initially disposed therebetween;

bending said thin wall material of said disposable container about an apex of one of said cutting teeth on said first cutting wheel;

transversely cutting said thin wall material in a direction which is transverse to said first direction with said apex of said one of said cutting teeth as said one of said cutting teeth initially begins to overlap trailing surfaces of preceding adjacent said cutting teeth of said cutting wheels adjacent to said one of said cutting teeth; and edge cutting said thin wall material in said first direction from opposite ends of a transverse cut produced by said transversely cutting between side edges of a leading surface of said one of said cutting teeth and adjacent side edges of said trailing surfaces of said preceding adjacent cutting teeth of said second cutting wheels which are adjacent to said one of said cutting teeth to complete said small pieces of said thin wall material.

16. The method as set forth in claim 15, wherein said bending includes initially entrapping a first uncut portion of said thin wall material between a leading surface of said one of said cutting teeth of said first cutting wheel and said trailing surfaces of said preceding adjacent cutting teeth of said second cutting wheels adjacent of said one of said cutting teeth.

17. The method as set forth in claim 16, wherein said bending includes entrapping a second uncut portion of said thin wall material between a trailing surface of said one of said cutting teeth of said first cutting wheel and leading surfaces of adjacent following cutting teeth of said second cutting wheels adjacent to said one of said cutting teeth.

* * * * *